United States Patent [19]

Wu

[11] 4,430,789

[45] Feb. 14, 1984

[54] METHOD FOR MANUFACTURE OF TARGET BOARDS FOR DARTS OR ARCHERY

[76] Inventor: Edward W. J. Wu, No. 62, Wu Chuan Si Er St., Taichung, Taiwan

[21] Appl. No.: 331,763

[22] Filed: Dec. 17, 1981

[51] Int. Cl.[3] ..... B22D 11/126; B28B 11/12

[52] U.S. Cl. ..... 29/527.1; 264/267; 264/269; 264/271.1; 264/278; 264/324; 264/138; 264/139; 264/157; 264/158; 264/159; 264/163; 273/408; 156/243

[58] Field of Search ..... 29/527.1, 527.2, 527.4, 29/527.6, 527.7, 527.5; 264/267, 269, 271, 277, 278, 324, 138, 139, 157, 158, 159, 163; 273/408; 156/243

[56] References Cited

U.S. PATENT DOCUMENTS 2,714,746 8/1955 Meyer ..... 29/527.1
4,235,444 11/1980 Meyer ..... 273/408

FOREIGN PATENT DOCUMENTS 1176663 11/1958 France ..... 29/527.1

*Primary Examiner*—Howard N. Goldberg
*Assistant Examiner*—V. K. Rising
*Attorney, Agent, or Firm*—Shoemaker and Mattare, Ltd.

[57] ABSTRACT

A method for the manufacture of target boards for darts or archery, wherein the target boards are made by: compressing fibrous material into a cylindrical bundle with a set of press molds provided with clamp members adapted to clamp the fibrous material so as to remain in cylindrical shape, cutting the cylindrical bundle into circular pieces each being clamped by a pair of clamp members; bonding a reinforcing plate onto one surface of each of the circular pieces; removing the clamp members from the circular pieces; banding the circular pieces with metal strips around the periphery and covering the second surface with a decorative cover sheet.

3 Claims, 7 Drawing Figures

METHOD FOR MANUFACTURE OF TARGET BOARDS FOR DARTS OR ARCHERY

BACKGROUND OF THE INVENTION

There are several conventional ways of making target boards for dart games or archery. One conventional way is to wrap fibrous material into a bundle which is then cut into a plurality of small cylindrical parts, the small cylindrical parts being then laid and tightly arranged on a flat joining device and then forced inwardly, whereupon they are banded with a metallic strip and bonded to a circular plate to become a circular board. Other methods include compressing fibrous material into a semicylindrical bundle by a press device and holding the fibrous material in a state of compression by means of sheet metal as disclosed in British Pat. No. 553,066, or by means of clamps as proposed by the U.S. Pat. No. 4,239,573. The semicylindrical bundles are then either joined to become a cylindrical body and cut into circular boards, or are cut into semicircular boards and then joined to become circular boards. In either way the manufacturing process includes many steps, and is therefore very time consuming.

In view of the aforesaid shortcomings of conventional methods, this invention proposes an improved method for making target boards for darts and archery.

BRIEF DESCEIPTION OF THE DRAWINGS

DETAILED DESCRIPTION OF THE INVENTION

Figure 2:
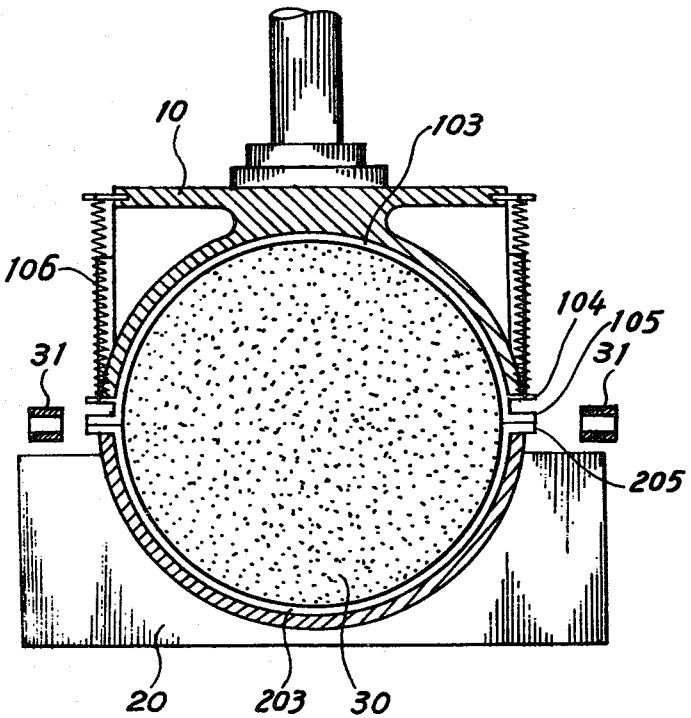
FIG. 2 is a schematic, cross sectional view of the mold having the fibrous material compressed therein.
Figure 1:
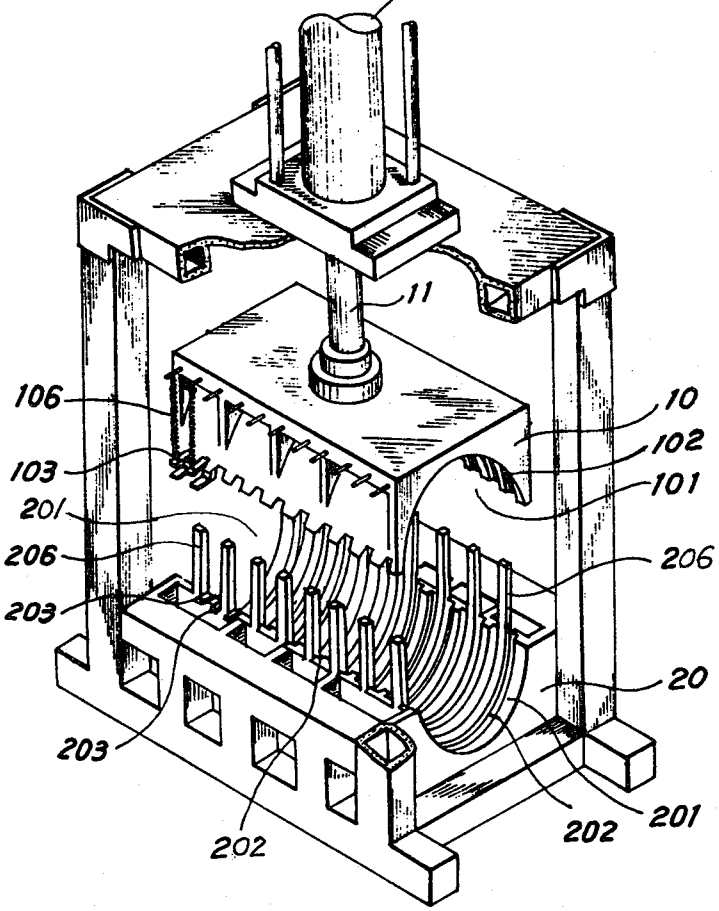
FIG. 1 is an oblique, perspective view, partially cutaway, of the press mold employed in the process of this invention.

FIG. 1 shows the press mold employed in the process for making the target boards of this invention. The press mold comprises an upper mold 10 and a lower mold 20. Upper mold 10 is provided with a shank 11 to be connected to a plunger 12 of a conventional press, not shown, and a cavity 101 generally in semicylindrical shape, cavity 101 being provided with a plurality of semicircular grooves 102 equally spaced apart at a suitable distance, each semicircular groove 102 being adapted to receive removably therein one upper clamp 103 respectively, with upper clamp 103 being formed into a semicircular shape to fit into semicircular groove 102, and having two ends each provided with first projection 104 and second projection 105 as shown in FIG. 2. Upper mold 10 is further provided with a plurality of retaining springs 106, each corresponding with each end of semicircular groove 102, springs 106 having one end pivotally fixed to upper mold 10 and the another end so formed to hook first projection 104 when upper clamps 103 are placed in semicircular grooves 102, so as to retain upper clamps 103 in place.

Lower mold 20 is mounted onto a boltster of the press equipment, and is provided with a cavity 201 of semicylindrical shape, cavity 201 having a plurality of semicircular grooves 202 equally spaced to correspond with semicircular grooves 102 of upper mold 10, each semicircular groove 202 being adapted to removably receive therein one lower clamp 203 to correspond with respective one upper clamp 103. Lower clamps 203 are each formed into a semicircular shape and provided with a projection 205 at each of its two ends as shown in FIG. 2. Each pair of upper and lower clamps 103, 203 is provided with two sleeves 31 each adapted to couple projection 205 of lower clamp 203 and second projection 105 of upper clamp 103 when they are brought to coincide with each other.

Further as shown in FIG. 1, lower mold 20 is provided with a plurality of guide posts 206 along the side edges of semicylindrical cavity 201 generally equally spaced at a suitable distance so as to keep the fibrous material in cavity 201 during the compression process.

To make the target boards, upper mold 10 is raised and kept in a raised position and a suitable quantity of fibrous material is axially laid in cavity 201 of lower mold 20 having lower clamps 203 first placed in semicircular grooves 201. Upper mold 10, having upper clamps 103 placed in semicircular grooves 102 and retained by retaining springs 106, is then lowered to compress the fibrous material, until second projections 105 of upper clamps 103 coincide with projections 205 of corresponding lower clamps 203 are coupled together by sleeves 31 as shown in FIG. 2. Thirdly, retaining springs 106 are disengaged from first projections 104 of upper clamps 103 and then upper mold 10 is raised, thus leaving in lower mold 20 the fibrous material having been compressed into a cylindrical fibrous bundle 30 and clamped by upper and lower clamps 103 and 203.

Figure 3:
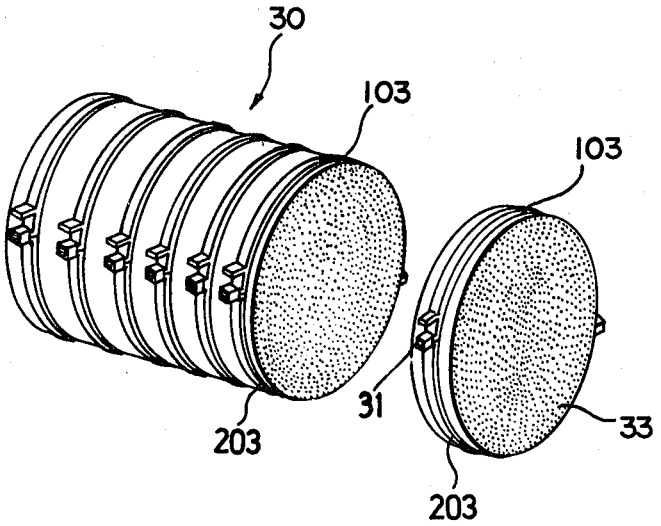
FIG. 3 is an oblique, perspective view of the compressed fibrous material being cut apart.

The cylindrical fibrous bundle 30 is then taken out of lower mold 20 and cut in between each two pairs of clamps by a suitable sawing machine into circular pieces 33 each being kept tight by one pair of upper and lower clamps 103 and 203, as shown in FIG. 3.

Figure 4:
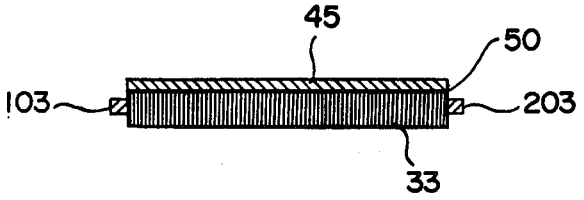
FIG. 4 is a cross sectional view of the circular fibrous piece having a circular reinforcing plate bonded on one planar side thereof.

Then a circular plate 45, which may be card board or plywood, is bonded with proper glue 50 onto one side of circular piece 33 while still being clamped by upper and lower clamps 103 and 203, as shown in FIG. 4.

Upper and lower clamps 103 and 203 are then removed from circular piece 33 by removing sleeves 31 first to separate upper clamps 103 from lower clamp 203. The fibrous material would be loosened slightly but will stay in circular shape by its own inherent cohesive properties.

Figure 5:
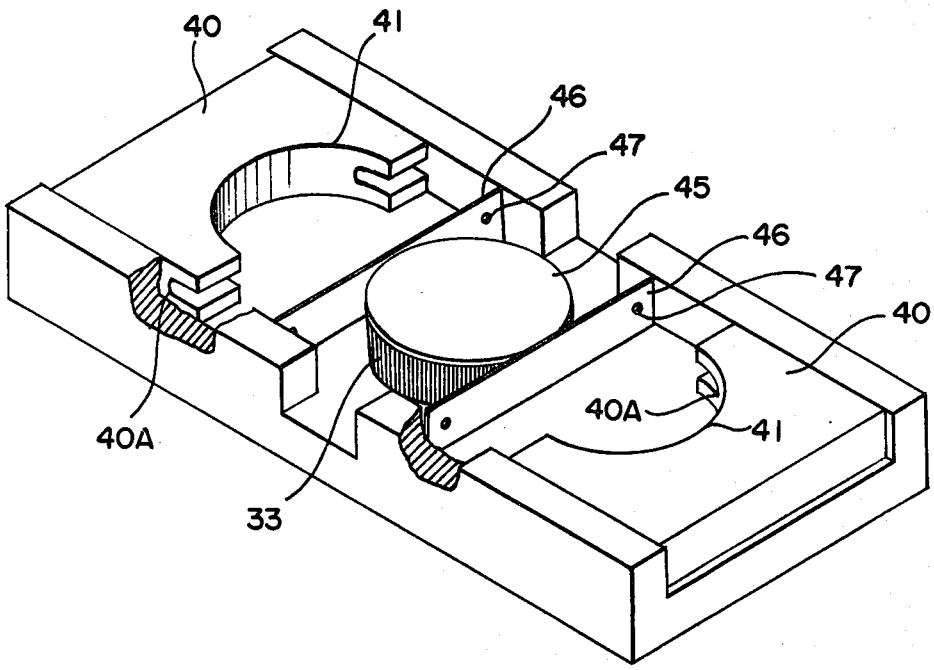
FIG. 5 is an oblique pe spective view of the circular fibrous piece being banded with a banding device.

Circular piece 33 having circular plate 45 bonded onto one side is then taken to a banding device to attach a band member therearound. The banding device as shown in FIG. 5 comprises two mold blocks 40 each having a semicircular cavity 41 generally corresponding to the circular shape of the circular piece 33. Circular piece 33 with reinforcing plate 45 is first laid in between two mold blocks 40, then in between the circular piece 33 and each mold block 40 is placed a metal strip 46 having a width generally equal to the thickness of circular piece 33, metal strip 46 being provided with a hole 47 at each of its two ends so that a rivet or a capscrew, not shown, may be inserted for fastening the two metal strips together later. Mold blocks 40 are then forced to move toward circular piece 33, forcing metal strips 40 to arcuately attach to the periphery of circular piece 33 and the end portions of metal strips 46 to overlap each other. Then metal strips 40 are fastened together with rivets or capscrews through cut out 40A formed in mold blocks 40 as shown in FIG. 5.

Figure 6:
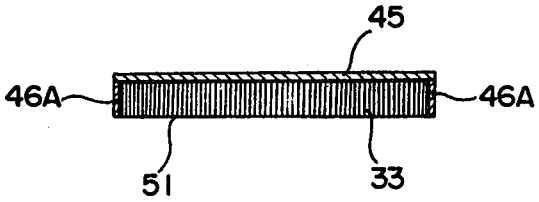
FIG. 6 is a cross sectional view of the completed target board made in accordance with the process of this invention.

Finally a decoration cover sheet 51 is put on the surface of the circular piece 33 having reinforcing plate 45 and band 46A, as shown in FIG. 6, to become a target board for darts and archery.

Figure 7:
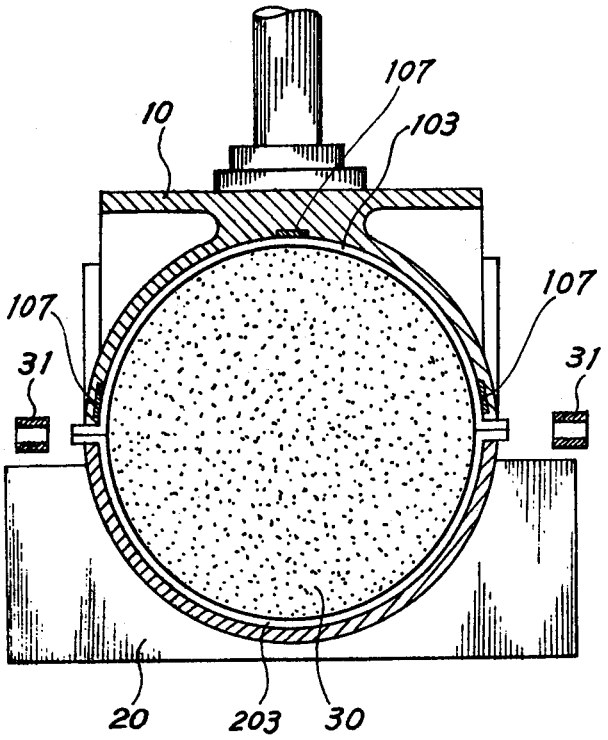
FIG. 7 is a schematic, cross-sectional view of a mold similar to the mold shown in FIG. 2 wherein springs have been replaced by permanent magnets.

To simplify the process, retaining springs 106 may be replaced by permanent magnet pieces 107 embedded in suitable positions in each semicircular grooves 102 of upper mold 10, as shown in FIG. 7, provided that upper clamp members 103 are made of ferro-magnetic material such as iron.

What I claim is:

1. A method of forming a target board for darts or archery, comprising the steps of:

providing an upper mold having a first semicylindrical cavity with a plurality of first arcuate grooves arranged in parallel and equally spaced;

providing a lower mold having a second semicylindrical cavity with a plurality of second arcuate grooves corresponding with said first arcuate grooves of said upper mold, said second cylindrical cavity being symmetrical to and corresponding with said first semicylindrical cavity of the upper mold;

placing an upper clamp member in each of said first arcuate grooves, said upper clamp members being detachably retained by a retaining means;

placing a lower clamp member in each of said second arcuate grooves of said lower mold;

placing a bunch of fibrous material on said second cylindrical cavity of said lower mold;

forcing said upper mold towards said lower mold and tightly pressing said bunch of fibrous material into a cylindrical fibrous bundle;

releasably coupling each of said upper clamp members to a corresponding one of said lower clamp members to maintain said fibrous material tightly pressed together in a cylindrical shape;

detaching said upper clamp members from said upper mold;

moving said upper mold away from said cylindrical fibrous bundle;

removing said cylindrical fibrous bundle and clamp members from said lower mold with said clamp members remaining on said fibrous bundle;

cutting said fibrous bundle between said clamp members into a plurality of clamped, circular pieces;

bonding a circular reinforcing plate onto one planar side of each circular piece;

decoupling said clamp members on each circular piece;

removing said decoupled clamp members from each circular piece;

placing a pair of metal strips adjacent to the circular piece;

forcing said metal strips around the periphery of said circular piece;

securing said metal strips together to form a protective band around the outer periphery of said circular piece; and placing a decoration cover sheet over said circular piece.

2. A method of forming a target board for darts or archery as recited in claim 1, wherein said retaining means is a plurality of springs each having one end pivotably fixed on to said upper mold and another end adapted to hook one end of each of said upper clamp members.

3. A method of forming a target board for darts archery as recited in claim 1, wherein said retaining means is a plurality of permanent magnet pieces embeded in each of said first arcuate grooves, and said upper clamp members are made of a ferro-magnetic material.

* * * * *